United States Patent [19]

Klaus

[11] 4,124,261

[45] Nov. 7, 1978

[54] DATA STORAGE UNIT

[75] Inventor: Gerald R. Klaus, St. Charles, Ill.

[73] Assignee: Fellowes Manufacturing Company, Franklin Park, Ill.

[21] Appl. No.: 779,098

[22] Filed: Mar. 18, 1977

[51] Int. Cl.[2] ..... A47B 63/00

[52] U.S. Cl. ..... 312/183; 312/184; 312/185; 312/233; 211/42; 281/21 R

[58] Field of Search ..... 312/185, 198, 291, 234.1, 312/8, 9, 12, 233; 402/4, 38; 190/1, 4; 211/45, 42; 248/441; 281/21

[56] References Cited

U.S. PATENT DOCUMENTS

| | | | |
|---|---|---|---|
| Re. 22,850 | 3/1947 | Bruen | 312/198 |
| 404,458 | 6/1889 | Woodruff | 312/234.1 |
| 531,939 | 1/1895 | Hires | 312/291 |
| 832,426 | 10/1906 | Sell | 312/185 |
| 989,968 | 4/1911 | Heil | 402/4 |
| 1,066,757 | 7/1913 | Rotzell | 402/4 |
| 1,158,808 | 11/1915 | Irwin | 312/234.1 |
| 1,503,227 | 7/1924 | Chipman | 312/12 |
| 1,908,678 | 5/1933 | Bliven | 312/198 |
| 2,501,608 | 3/1950 | Lyons | 312/233 |
| 2,511,730 | 6/1950 | McClain | 211/45 |
| 2,659,512 | 11/1953 | Czerniawski | 402/4 |
| 2,761,451 | 9/1956 | McIlrath | 402/4 |
| 2,794,697 | 6/1957 | Bergman | 312/233 |
| 3,790,242 | 2/1974 | Sullivan | 312/184 |

FOREIGN PATENT DOCUMENTS

| | | | |
|---|---|---|---|
| 2,417,454 | 4/1974 | Fed. Rep. of Germany | 402/4 |
| 422,598 | 3/1911 | France | 312/233 |

*Primary Examiner*—Victor N. Sakran
*Attorney, Agent, or Firm*—Roy E. Hofer

[57] ABSTRACT

An improved data storage unit for storing computer printout sheets is provided which includes at least one open-ended compartment and at least one portable binder adapted to be positioned horizontally in the compartment with its back end facing outwardly thereof. Preferably there is mounted on the binder's back end a label holder which allows the contents of the binder to be easily identified by visual observation of the storage unit. When the unit includes a plurality of compartments, they are preferably disposed in a vertical alignment.

7 Claims, 7 Drawing Figures

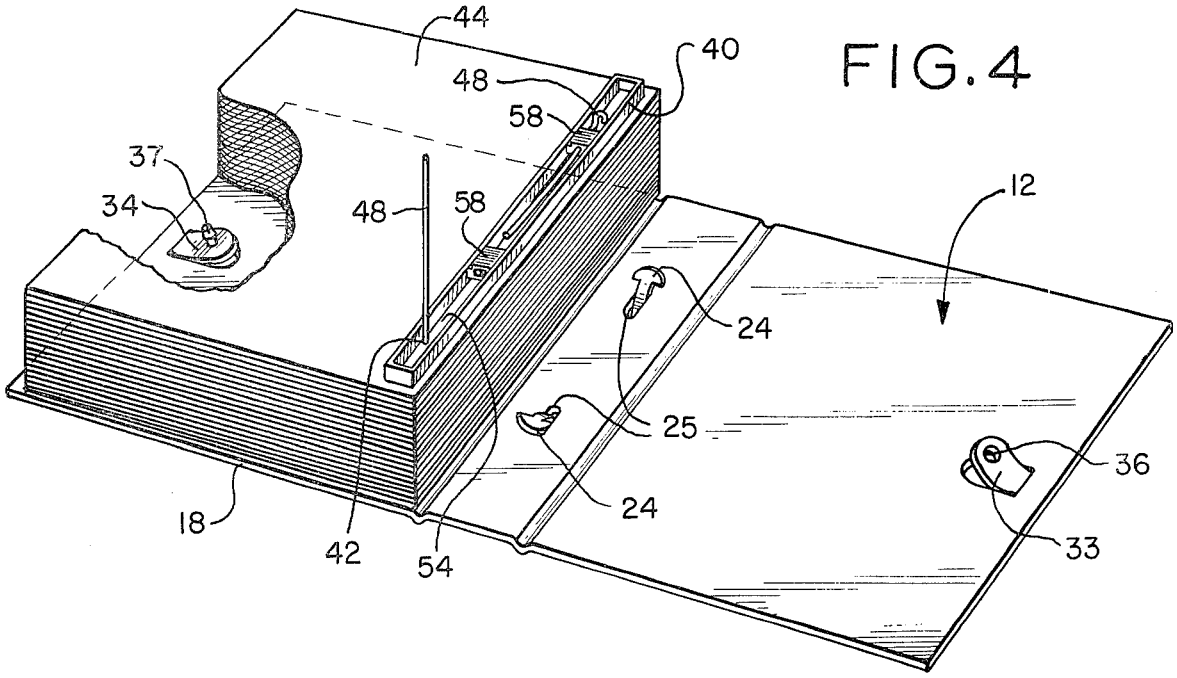
FIG. 4
FIG. 5
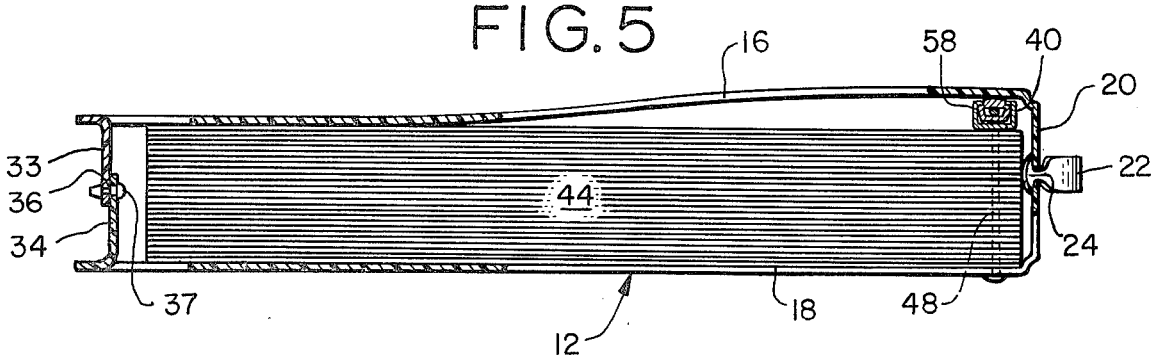
FIG. 7
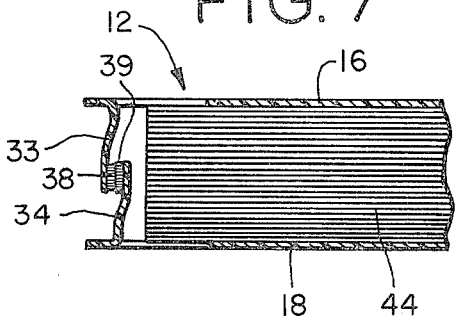
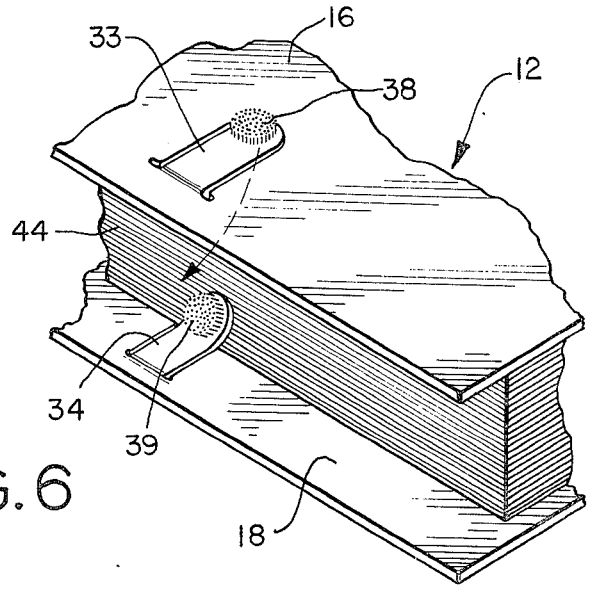
FIG. 6

DATA STORAGE UNIT

BACKGROUND OF INVENTION

This invention relates to an improvement in data storage units and, more particularly, to an improved unit for the storage and filing of computer printouts wherein the printouts are not only bound in portable binders but are also stored in a flat position in such a manner that the identity of binders both present in the unit and absent therefrom is easily ascertained by visual observation.

Many businesses compile data on computer printouts. It is greatly desirable that the printouts are available for quick reference which necessitates storage of such printouts in an organized fashion in such a manner that the data is readily accessible for use. It is also desirable that the printouts be stored in such a manner that they are easily filed and easily retrievable.

One method of storing printouts is to hold them in portable binders which binders protect and maintain the order of the printouts during use and which binders are often stored together when the printouts are not being used. It has been the general practice with respect to such printout binders to adapt the binders to be carried in the manner of a suitcase and to store such binders in a suspended position. The binders generally include a front cover, a back cover, and a back end interconnecting the two covers. The back end normally includes a carrying handle and a channel which channel is adapted for storage of the binders in a suspended position. The binders are stored by mounting them on rods which are inserted into and through the channel on the back end. The rods are mounted in various compartments including stationary file drawers and movable cabinets. The channel runs the length of the binder's back end and the binders are therefore slideable on the mounting rod.

A serious disadvantage of this known method of storing binders and the bound printout sheets is the difficulty in determining the proper position to which a binder should be returned due to the binders being slideable on the rod. If any of the slideable stored binders are moved, the order of the storage arrangement is disturbed. The binders do not have a permanently reserved position on the rod and the possibility of misfiling these binders is great. Another disadvantage is the stress placed on the printout sheets by being stored in a suspended position which can result in unnecessary wear of these sheets.

It is an object of this invention to provide an improved storage unit for printout sheets which includes at least one binder suitable for holding a series of these sheets and a storage compartment for each binder which allows the binder and the printout sheets to be stored in a horizontal position and yet be conveniently compact. It is another object to provide a storage unit for data printout sheets which allows the binders to be readily identifiable, easily removed and easily replaced. It is further object to provide an improved storage unit for printout sheets which permits an accurate and simple determination of the identity of any removed binders. It is another object to provide a storage unit wherein each binder is lodged in its own permanent compartment which allows accurate refiling of the binder in the same compartment.

SUMMARY OF INVENTION

The foregoing and other objects are realized in accord with the invention by a combination of at least one suitable binder for data printout sheets which holds the printout sheets in a booklet form and at least one storage compartment which is adapted to hold the binder in a horizontal laying position in such a manner that the binder's back end is faced outwardly from the unit. When the storage unit includes more than one binder and compartment, the compartments separate the stored binders. The binders are slid in and out of the compartments without the necessity of mounting rods or the like. The individualized compartments assure that the order of the binders will not be disturbed when one or more of the binders are removed. The individual compartments are preferably provided by a series of horizontal shelves positioned one above the other in a box-like cabinet which may be completely open-ended along the side wherein the back ends of the binders face outwardly.

In a preferred embodiment of the invention the storage unit may be provided with a door that closes the open side from view. Another preferred embodiment is a storage unit including binders which have label holders for identifying contents mounted on the binder's back end, which end faces outwardly of the storage unit when the binders are placed therein in a horizontal position. A further preferred embodiment is a combination including the wheel means mounted on the bottom of the storage unit to provide a movable storage unit.

The binders generally include a bar of rigid material whose length is approximately the length of the binder and which has holes or apertures along its length corresponding to the pin holes of unburst data sheets to be inserted therein. The bar may have a groove within which two U-shaped holder members are mounted standing on their legs. Flexible straps are secured to the back cover of the binder and adapted to each pass through a hole in the bar. When data sheets are mounted, these straps, spaced apart and near opposed ends of the bar, are each threaded through an alignment of pin holes in the sheets and the corresponding hole on the bar so that the bar is positioned on the top of the data sheets. The straps are then secured aligned with the bar, such as by placing them into the groove of the bar and sliding the U-members on top of the straps. The U-members can be mounted on a bar without a groove and adapted to secure the straps such as by mounting the U-members over the bar. Variations of this means for binding the printout sheets are well known to those of ordinary skill in the art. The binders preferably include tabbed locking means which allow them to be safely transported by hand. Although the binders are generally used for unburst printout sheets, they can also hold burst sheets if separated in a manner that does not remove the pin holes.

The invention and its objects, methods of operation, features and advantages will be more fully understood by reference to the following drawings and the detailed description.

DESCRIPTION OF THE DRAWINGS

FIG. 4 is a perspective view of a partially cut-away binder of the data storage unit of the present invention in an open position and containing data printouts sheets in a partially secured position;

FIG. 5 is a end view of a closed binder of the data storage unit of the present invention;

FIG. 6 is a partially cut-away perspective view of a binder embodying preferred features of the present invention, and FIG. 7 is a partially cut-away side view of the binder of FIG. 6.

DETAILED DESCRIPTION OF THE INVENTION

Figure 3:
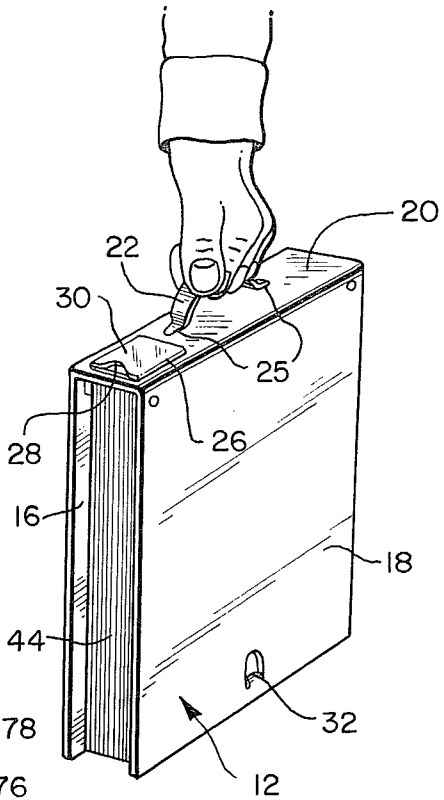
FIG. 3 is a perspective view of a printout binder of the data storage unit of the present invention being transported by hand.
Figure 2:
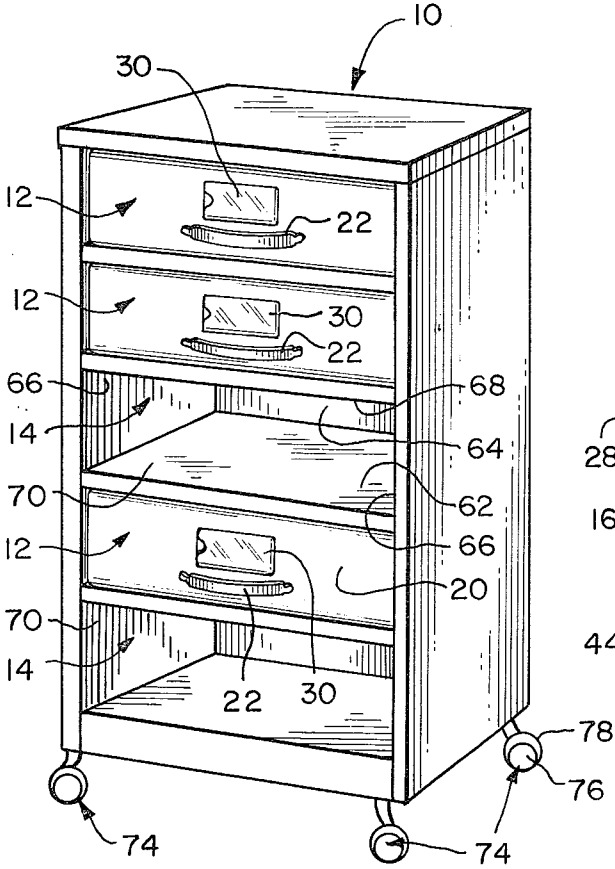
FIG. 2 is a perspective view of a data storage unit embodying the features of the present invention.
Figure 1:
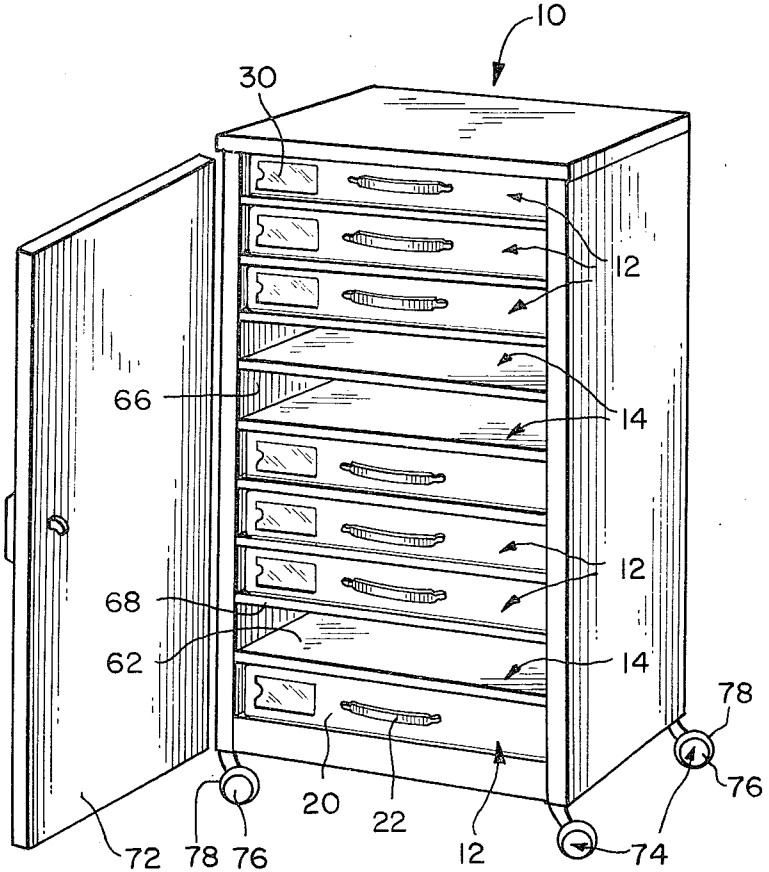
FIG. 1 is a perspective view of a data storage unit embodying the features of the present invention.

Referring now to the drawings, particularly FIGS. 1 and 2, there is illustrated a storage unit embodying features of the present invention, indicated generally by the reference numeral 10. The storage unit 10 includes a plurality of printout binders generally designated 12 and a plurality of compartments designated generally 14. The binders 12 are adapted to be placed in compartments 14 in a horizontal position which position results in less stress being placed on the storage material as compared to the prior art method of storing binders in a suspended position. When a binder 12 is removed from the storage unit 10, the individualized compartments 14 permit simple determination that the binder 12 has been removed and allows accurate refiling of the binder 12. As illustrated in FIG. 3, the binders 12 are readily portable and yet are also simply stored by placement in the appropriate compartment 13 without any alterations.

Considering the binders 12 in more detail and referring also to FIGS. 4 and 5, each binder 12 includes a first cover 16, a second cover 18 and a back end 20 which interconnects the first and second covers 16 and 18 in a hinged manner so that the binder 12 may be opened and laid out flat as best shown in FIG. 4 or folded into a closed position as best shown in FIG. 5. The binder 12 can optionally include a handle means 22 mounted on the back end 20.

The preferred handle means 22 has tab means 24 at its opposite ends which are inserted into apertures 25 provided on a binder's back end 20 to secure the handle means 22 to the binder 12. Any suitable handle means 22 which may be mounted on the back end 20 of the binder 12 may be used, the selection and adaptation of such handle means being within the ordinary skill of one in the art.

A binder 12 can also optionally include a label holder means 26 mounted on its back end 20. The label holder means 26 is a preferably transparent with an open-end 28 into which a label 30 designating the contents of the binder 20 may be slid. Any suitable label holder means 26 may be used in combination with the binder 12 and may be mounted by any suitable means on the back end of 20 of the binder 12, the selection of such label holder means being within the ordinary skill of one in the art. When the binders 12 are positioned horizontally in compartment 14, the handle means 22 and label holder means 26 can face outwardly of the compartments 14.

The binder 12 each are provided with a suitable retention mechanism for securing the data printout sheets 44. The retention mechanism illustrated includes a rigid bar 40 with at least two apertures 42 positioned along its length and two straps 48. When printout sheets 44 are secured to a binder 12, the rigid bar 40 of the binder 12 overlies the sheets 44 and the apertures 42 of the bar 40 are so positioned as to be aligned with pin holes (not shown in the drawings) on the printout sheets 44. The straps 48 are mounted on the second cover 18 of the binder 12 and when sheets 44 are secured in the binder 12, the strips 48 are threaded through aligned pin holes of the sheets 44 and through the aligned apertures 42 of the bar 40. The bar 40 also includes a groove 54 wherein are slideably mounted two U-members 58 which U-members 58 are secured in the groove 54 by their flanged edges (not shown in the drawings). When printout sheets 44 are secured in a binder 12, the straps 48 are bent toward each other adjacent to the groove 54 and are secured in this position by the U-members 58 which are positioned to overlie the straps 48. The binders 12 may be varying thickness, such as two inches thick or four inches thick as illustrated respectively in FIGS. 1 and 2.

A binder 12 can also optionally contain a locking means designated generally 32 which preferably is a first tab 33 and a second tab 34 mounted on the first and second covers 16 and 18 respectively. The first and second tabs 33 and 34 may include respectively an aperture 36 and a knob 37 which mate to lock or retain the first and second covers 16 and 18 in substantially parallel alignment, as illustrated in FIGS. 4 and 5.

In a preferred embodiment, illustrated in FIGS. 6 and 7, the first and second tabs 33 and 34 include respectively a plurality of loops 38 and a plurality of hooks 39 which loops 38 and hooks 39 mate to lock or retain the first and second covers 16 and 18 in substantially parallel alignment. The loops 38 are preferably of a flexible material and of sufficiently smally size that a great number cover the end of the first tab 33. The hooks 39 are preferably of a more rigid material than the loops 38 and are of comparable size although fewer hooks 39 than loops 38 are necessary to secure tabs 33 and 34. This type of securing means is commercially available (Velcro fastener) and has been used before in areas other than the data storage field.

The compartments 14 each include a bottom wall 62, a rear wall 64, two side walls 66 and an upper wall 68. The rear wall 64 and side walls 66 of the individual compartments 14 may form three continuous sides of the storage unit 10 and the bottom wall 62 of one compartment 14 may be the upper wall 68 of the adjacent underlying compartment 14 when the compartments 14 are aligned vertically in an integrated unit 10. The compartments 14 have one open-end 70. The binders 12 are adapted so as to be positioned with their back ends 20 facing outwardly of the compartments 14 at their open-ends 70. A handle means 22 and label holder means 26 mounted on the back end 20 of a binder 12 would therefore be positioned outwardly of its compartment 14.

A storage unit 10 may optionally include a door means 72 mounted along a side of the unit 10 which closes from view the open-ends 70 of the compartments 14. The door means 72 may be any suitable enclosure means mounted in any convenient manner which are well known to those skilled in the art. In a preferred embodiment of the invention, the door 72 is mounted by hinging along a corner of the unit 10 formed collectively by edges of the side walls 66 of the individual compartments 14 which hinged door 72 opens to allow free access to the compartments 14. A storage unit 10 may also optionally include roller means designated generally 74 which provide portability to the unit 10. The roller means 74 may be any suitable roller means, the selection of which is within the skill of one with ordinary skill in the art. A preferred roller means 74 are casters 76 with treads 78 of non-marring material such as rubber.

The first and second covers 16 and 18 and back end 20 of the binders 12 may be composed of any suitable material such as a medium density plastic so as to provide protection to the printout sheets 44 bound therein during handling and storage. The handle means 22 of the binder 12 may also be composed of any suitable material such as medium density plastic. Suitable materials and the selection thereof are within the ordinary skill of one in the art.

The bottom wall 62, rear wall 64 and upper wall 68 of a compartment 14 may be formed of any suitable self-supporting material and these walls can be joined together by a suitable means well known to those of ordinary skill in the art. A preferred material is a metal or a rigid plastic or a combination thereof.

Although the heights of the compartments 14 are illustrated as being all the same in a particular storage unit 10, this need not be the case and compartments 14 of varying heights may be provided within a single storage unit 10 to allow storage of binders 12 of varying thicknesses.

It will be understood that changes may be made in the details of construction, arrangement and operation without departing from the spirit of the invention, particularly as defined in the following claims.

What is claimed is:

1. A storage unit for computer printout sheets with side pin holes comprising in combination:

at least one compartment including a horizontal bottom wall and an open end;

at least one portable binder for binding said printout sheets to be positioned in said compartment, including a back end, and a first cover and a second cover wherein said back end can face outwardly of the open end of said compartment when said binder is stored in a horizontal position, enclosing the open end of the compartment whereby said printout sheets are stored horizontally; and wherein said binder includes a handle means mounted on said back end whereby said binders may be slideably removed and replaced, wherein at least one binder includes:

a locking means;

a rigid bar including a plurality of apertures extending the length of the bar;

at least one U-member adapted to be slideably mounted on said bar;

a first strap; and a second strap, said first second straps being each secured to said second cover of said binder and adapted to each be extended through an aperture in said bar and to be secured aligned with said bar by said U-members.

2. The storage unit of claim 1 wherein the locking means includes a first tab with a plurality of loops and a second tab with a plurality of hooks adapted to mate to secure the first and second covers in substantially parallel alignment.

3. The storage unit as defined in claim 1 wherein said binder further includes a label holder means mounted on said back end, whereby said binder may be easily identified by visual observation while disposed in said compartment.

4. The storage unit of claim 3, wherein a plurality of compartments are defined by a plurality of substantially horizontally disposed shelves for storing a plurality of binders, whereby the binders can be separately stored in individual compartments.

5. The storage unit of claim 3 further including roller means.

6. The storage unit of claim 5 further including a door means.

7. An integrated series of compartments for storing binders for computer printout sheets in a horizontal flat position comprising in combination:

a plurality of compartments at least two of which are positioned in a vertical alignment, said compartments each including at least one open end allowing visual observation of said binders; and a plurality of portable binders for computer printout sheets, which binders each include a first and second cover and a back end, which back end encloses the open end of the compartment in which the binder is stored, and said back end having handle means and label holder means mounted thereon allowing visual identification of the binders and facilitating access thereto, wherein at least one binder includes:

a locking means;

a rigid bar including a plurality of apertures extending the length of the bar;

at least one U-member adapted to be slideably mounted on said bar;

a first strap; and a second strap, said first and second straps being each secured to said second cover of siad binder and adapted to each be extended through an aperture in said bar and adapted to each be extended through an aperture in said bar and to be secured aligned with said bar by said U-members.

* * * * *